US007516510B2

(12) United States Patent
Tanaka

(10) Patent No.: US 7,516,510 B2
(45) Date of Patent: Apr. 14, 2009

(54) CLEANING SHEET

(75) Inventor: Yoshinori Tanaka, Kawaga (JP)

(73) Assignee: Uni-Charm Corporation, Ehime-Ken (JP)

( * ) Notice: Subject to any disclaimer, the term of this patent is extended or adjusted under 35 U.S.C. 154(b) by 831 days.

(21) Appl. No.: 11/200,378

(22) Filed: Aug. 8, 2005

(65) Prior Publication Data

US 2006/0064834 A1 Mar. 30, 2006

(30) Foreign Application Priority Data

Sep. 30, 2004 (JP) ..... 2004-286321

(51) Int. Cl.
*A47L 13/16* (2006.01)

(52) U.S. Cl. ..... 15/228; 15/208; 15/209.1; 442/328; 442/329; 442/381

(58) Field of Classification Search ..... 15/208, 15/209.1, 228; 442/328, 329, 381; 401/137–140
See application file for complete search history.

(56) References Cited

U.S. PATENT DOCUMENTS 5,292,582 A * 3/1994 Gibbs et al. ..... 442/329
2003/0121116 A1 7/2003 Keck et al.
2003/0209263 A1 11/2003 Bell et al.

FOREIGN PATENT DOCUMENTS

| | | |
|---|---|---|
| EP | 1537819 | 6/2005 |
| JP | 3022675 | 1/1996 |
| JP | 09-182706 | 7/1997 |
| JP | 10-155713 | 6/1998 |
| JP | 11-000295 | 1/1999 |
| WO | 97/35510 | 10/1997 |
| WO | 2004/041051 | 5/2004 |

* cited by examiner

*Primary Examiner*—Mark Spisich
(74) *Attorney, Agent, or Firm*—Darby & Darby P.C.

(57) ABSTRACT

Disclosed is a cleaning sheet including a main body which is intended to be placed on a bottom face of a cleaning head and attachment sheets which extend from the main body and are intended to be secured on a top face of the cleaning head. The main body has an attachment surface and a cleaning surface on opposite sides. The attachment surface is intended to face the bottom face of the cleaning head. The main body includes a substrate sheet and a stretchable support sheet disposed on a cleaning surface side of the substrate sheet to have projections extending beyond opposite side edges of the substrate sheet. Each attachment sheet is joined to a respective projection of the support sheet.

7 Claims, 6 Drawing Sheets

CLEANING SHEET

BACKGROUND OF THE INVENTION

1. Field of the Invention

The present invention relates to a cleaning sheet which is intended to be attached to a cleaning head provided at a front end of a mop-like cleaning device or the like, and more particularly to a cleaning sheet which can be tightly fixed on a bottom face of the cleaning head.

2. Description of the Related Art

There have been known mop-like cleaning devices with a cleaning head at a front end for cleaning the house floor or the like. To this cleaning head of the cleaning device, there may be attached a disposable cleaning sheet formed from a nonwoven fabric or the like.

Japanese Utility-Model Registration No. 3022675 discloses a cleaning device with slits on the top face of the cleaning head for attachment of the cleaning sheet. The cleaning sheet can be fixed on the cleaning head such that opposite side portions of the cleaning sheet, whose central portion is located beneath the bottom face of the cleaning head, are folded back upon the top face of the cleaning head and tucked into the slits.

On the other hand, Japanese Unexamined Patent Application Publication No. H09-182706 discloses a cleaning device with pivotable clamping members on the top face of the cleaning head. The cleaning sheet can be fixed on the cleaning head such that opposite side portions of the cleaning sheet, whose central portion is located beneath the bottom face of the cleaning head, are folded back upon the top face of the cleaning head and held between the clamping members and the cleaning head.

Conventional cleaning devices have the following problems.

Conventional cleaning sheets, which are typically constructed of one or more nonwoven fabrics, are not stretchable at all or stretchable but with an extremely low elongation percentage. Accordingly, when the opposite side portions of the cleaning sheet, whose central portion is located beneath the bottom face of the cleaning head, are secured by the slits or the clamping members on the top face of the cleaning head, the whole cleaning sheet tends to be loose around the cleaning head, which may cause displacement between the cleaning sheet and the cleaning head when the cleaning sheet is slid on a floor surface or the like.

Japanese Unexamined Patent Application Publication No. H11-295 discloses a stretchable cleaning sheet which has an elongation percentage of 20% or less under a load of 5 N/30 mm. However, this stretchable cleaning sheet has a uniform construction throughout and therefore has a uniform stretchability throughout. Accordingly, when the cleaning sheet is attached to the cleaning head in such a manner that the opposite side portions of the cleaning sheet are pulled and secured by the slits or the clamping members, the pulling force is spread over the whole cleaning sheet, which makes it difficult to tightly fix the cleaning sheet on the bottom face of the cleaning head.

Cleaning sheets of this type are typically constructed to be suitable for cleaning in the central portion located between the opposite side portions, and therefore, when the displacement occurs, one of the opposite side portions, which are not suitable for cleaning, tends to be positioned on the bottom face of the cleaning head.

SUMMARY OF THE INVENTION

The present invention has been developed to solve the problems in the prior art set forth above and has an object to provide a cleaning sheet whose main body can be tightly fixed on a bottom face of a cleaning head, preventing displacement during use.

According to the present invention, there is provided a cleaning sheet comprising a main body which is intended to be placed on a bottom face of a cleaning head and attachment sheets which extend from the main body and are intended to be secured on a top face of the cleaning head, the main body having an attachment surface and a cleaning surface on opposite sides, the attachment surface being intended to face the bottom face of the cleaning head, the main body including a substrate sheet and a stretchable support sheet disposed on a cleaning surface side of the substrate sheet to have projections extending beyond opposite side edges of the substrate sheet, each attachment sheet being joined to a respective projection of the support sheet.

Under an equal tensile stress, the support sheet may have a higher elongation percentage than the substrate sheet and the attachment sheet.

When the cleaning sheet of the present invention is fixed on the cleaning head to have the main body beneath the bottom face of the cleaning head with the attachment sheets placed on the top face of the cleaning head, the projections of the support sheet can be slightly stretched to tightly press the opposite side portions of the substrate sheet against the bottom face of the cleaning head. This effectively prevents displacement of the substrate sheet on the bottom face of the cleaning head.

Preferably, the support sheet has an elongation percentage of 10% or more when a tensile load of 2 N per 25 mm width is exerted for 30 seconds in a direction along which the projections project from the substrate sheet and a recovery percentage of 90% or more after 30 seconds after removal of the tensile load.

Preferably, each attachment sheet is joined at a proximal end to an attachment surface side of the support sheet in face-to-face relationship while having a distal end directed toward center of the main body. With this construction, the attachment sheets and the support sheet form pockets, which open toward the center of the main body, on opposite sides of the main body. Accordingly, the cleaning sheet can be attached to the cleaning head with the opposite side portions of the cleaning head disposed in the pockets, which prevents displacement between the cleaning sheet and the cleaning head more effectively.

According to one embodiment of the present invention, the attachment sheets may be joined to the support sheet at locations spaced outward from the opposite side edges of the substrate sheet. With this construction, when the substrate sheet of the main body is laid beneath the bottom face of the cleaning head, the join portions between the support sheet and the attachment sheets may be placed on side walls of the cleaning head rather than on the bottom face, which is intended to face a floor surface or the like. This enables the whole bottom face of the cleaning head to be effectively exploited as a cleaning face and prevents the join portions from damaging a delicate floor surface or the like.

According to one embodiment of the present invention, the support sheet may be joined to the cleaning surface side of the substrate sheet at locations spaced inward from the opposite side edges of the substrate sheet and may be permitted to stretch outside the locations where the support sheet is joined to the substrate sheet. In this construction, the stretchable portions of the support sheet may be so adjusted that the substrate sheet will be tightly pressed against the bottom face of the cleaning head by an elastic force of the support sheet.

According to one embodiment of the present invention, the support sheet may be a through-air bonded nonwoven fabric.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only.

In the drawings.

DESCRIPTION OF THE PREFERRED EMBODIMENT

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

Figure 1:
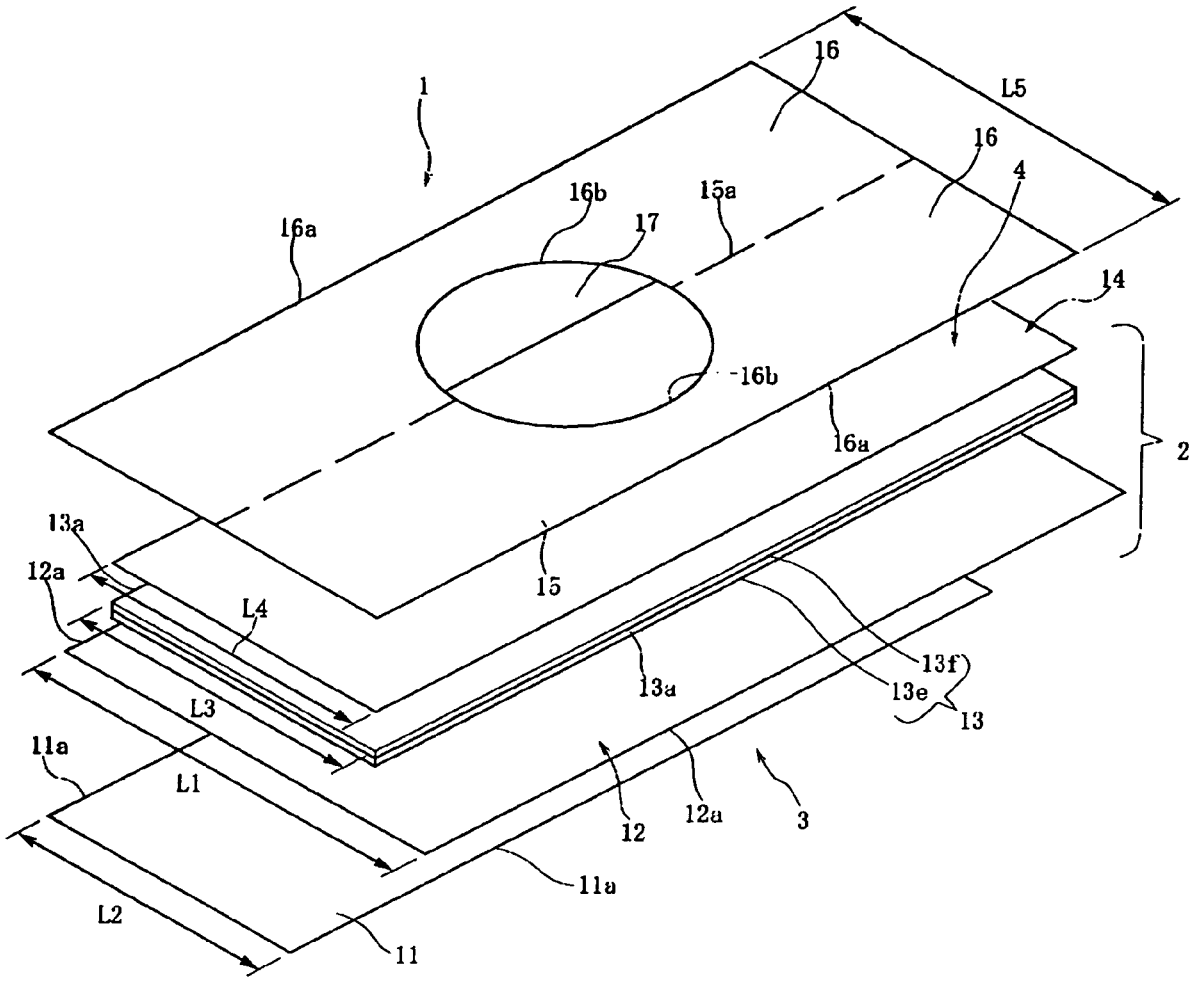
FIG. 1 is an exploded perspective view of a cleaning sheet according to one embodiment of the present invention.
Figure 2:
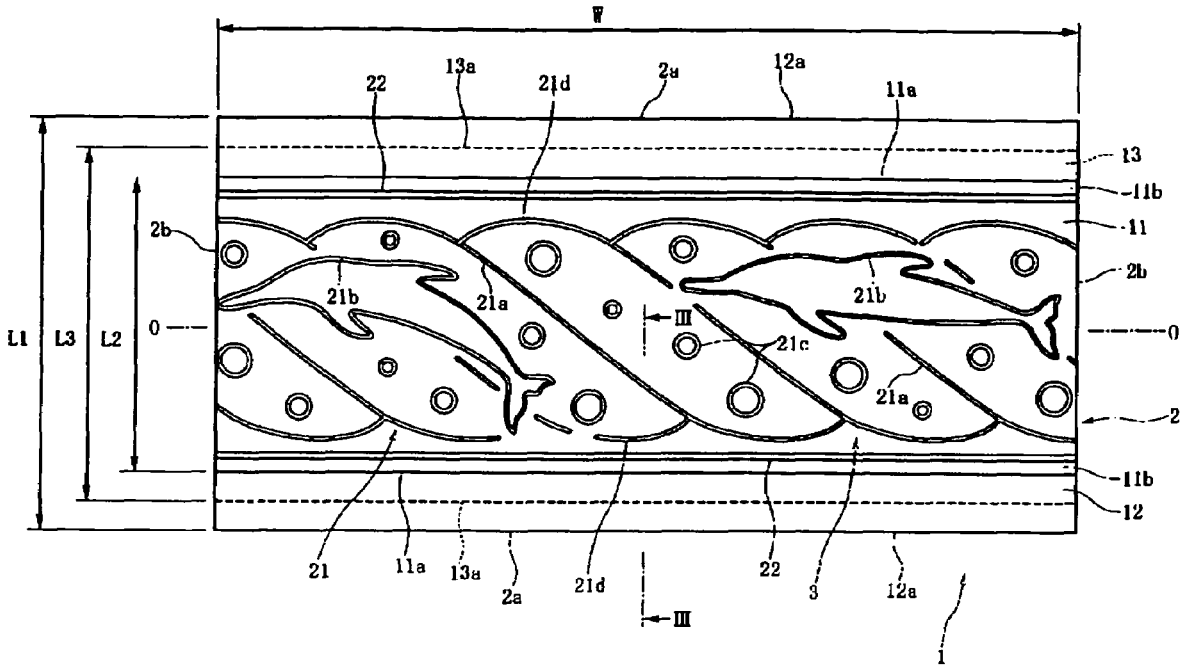
FIG. 2 is a bottom view showing a cleaning surface of the cleaning sheet.
Figure 3A:
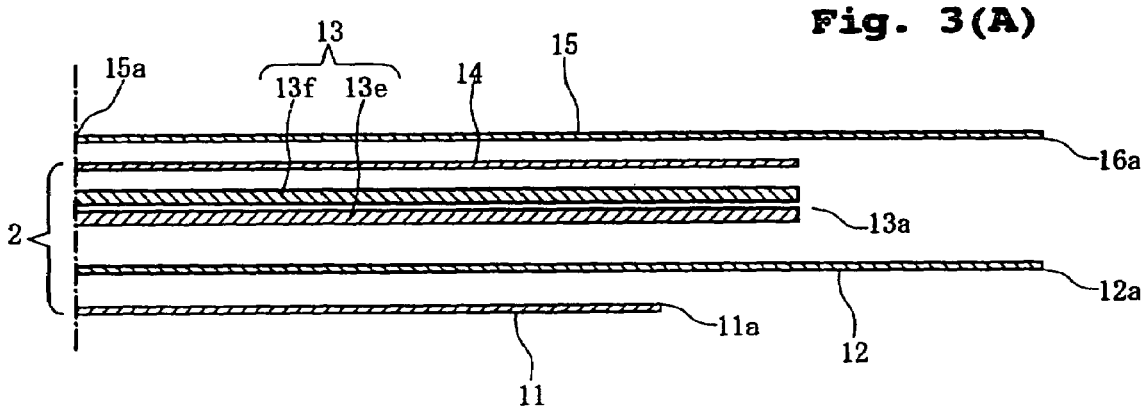
FIG. 3(A) is a half sectional view of the cleaning sheet taken along line III-III of FIG. 2, wherein components are in an exploded state before joining.
Figure 3B:
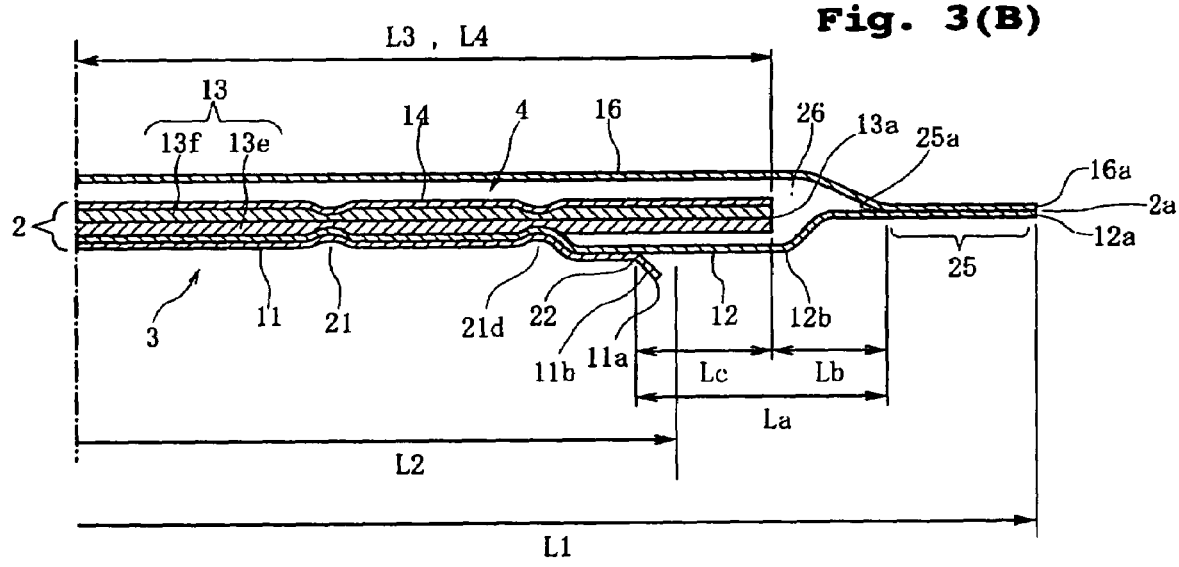
FIG. 3(B) is a half sectional view of the cleaning sheet taken along line III-III of FIG. 2, wherein components are joined together.
Figure 4:
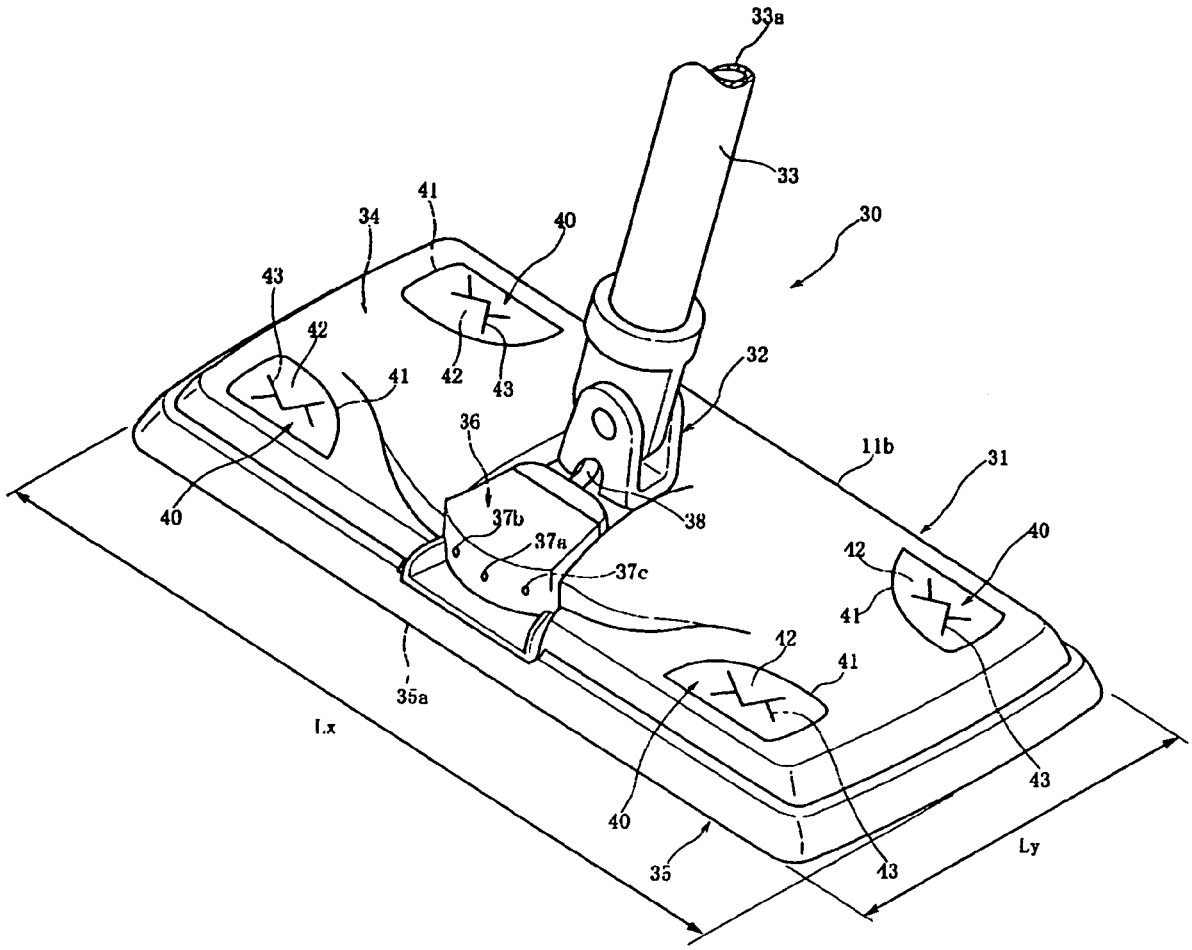
FIG. 4 is a perspective view of a cleaning head suitable for attachment of the cleaning sheet.
Figure 5:
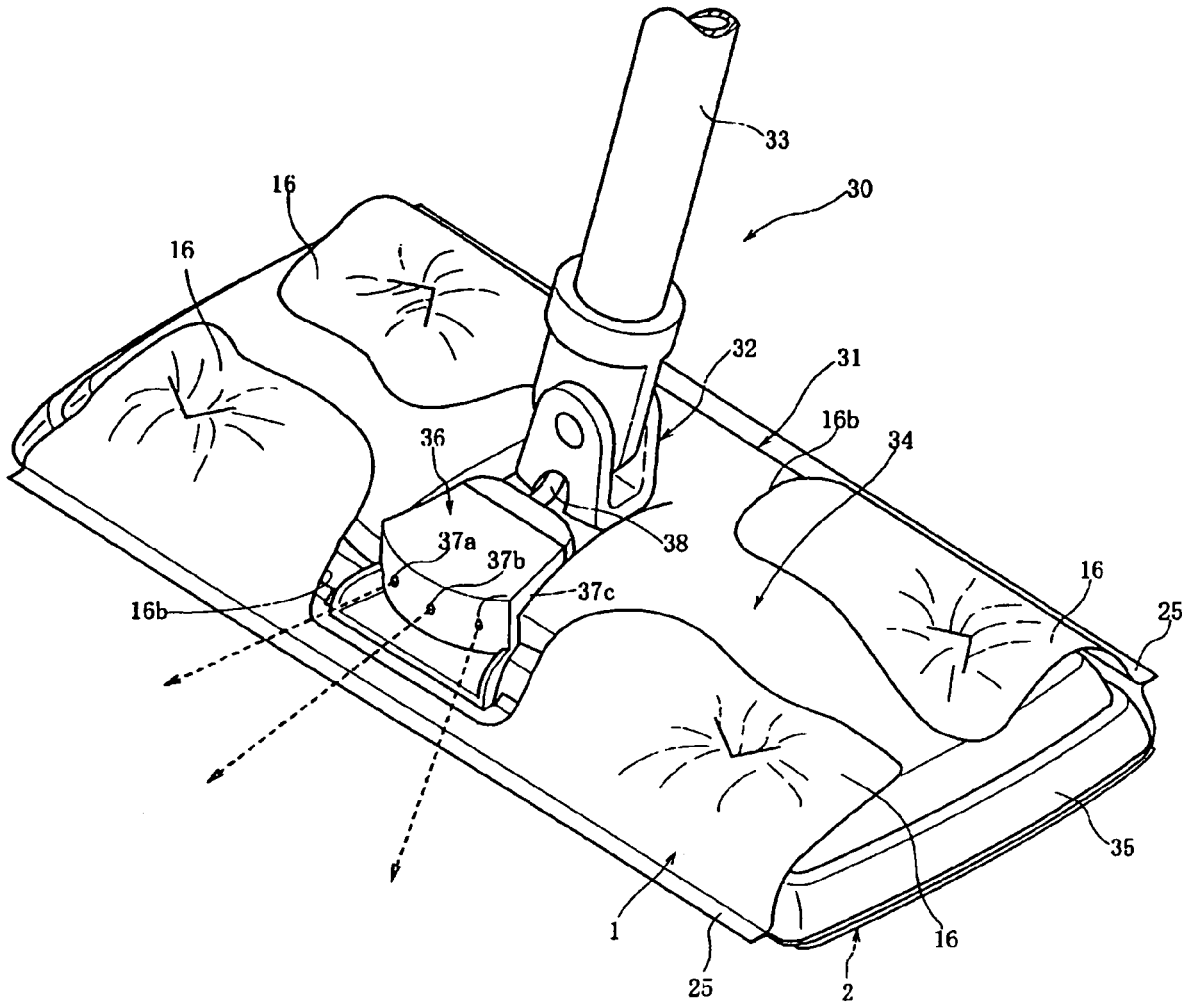
FIG. 5 is a perspective view showing a state where the cleaning sheet is attached to the cleaning head.
Figure 6:
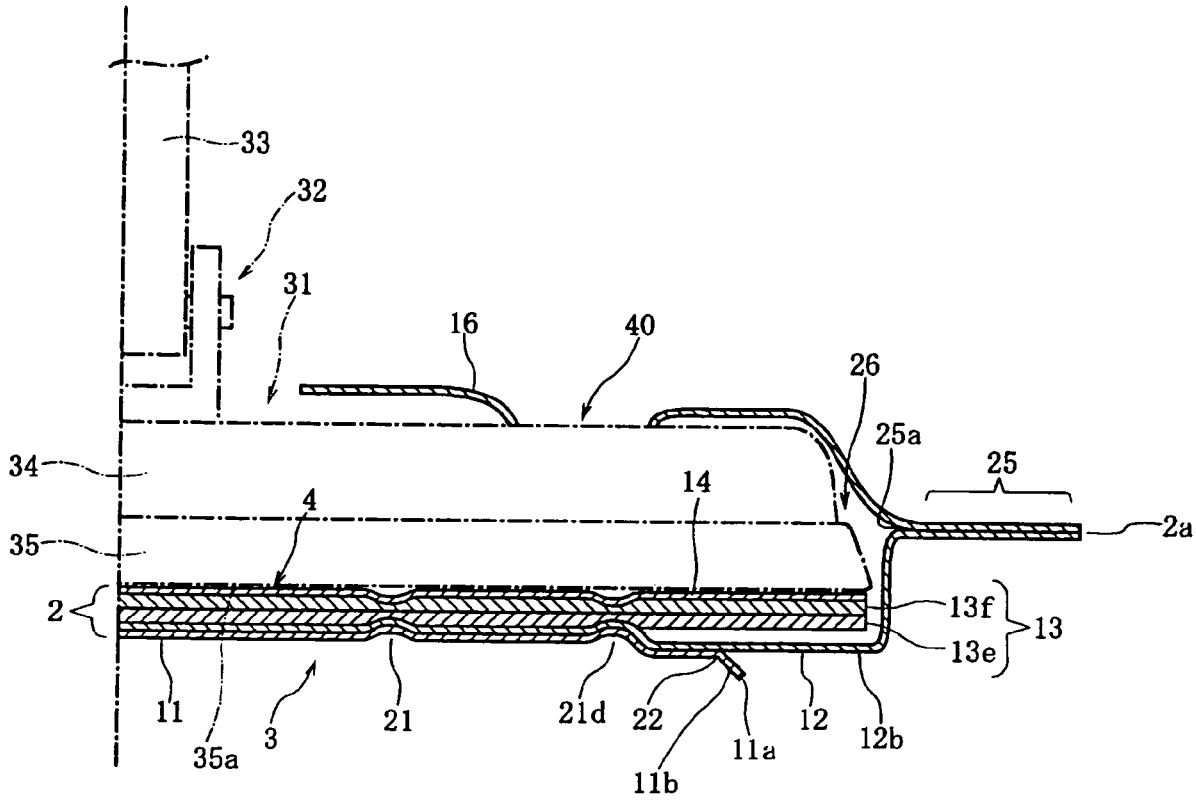
FIG. 6 is a half sectional view showing a state where the cleaning sheet is attached to the cleaning head.

FIG. 1 is an exploded perspective view of a cleaning sheet according to one embodiment of the present invention; FIG. 2 is a bottom view showing a cleaning surface of the cleaning sheet; FIG. 3(A) is a half sectional view of the cleaning sheet taken along line III-III of FIG. 2, wherein components are in an exploded state before joining, FIG. 3(B) is a half sectional view of the cleaning sheet taken along line III-III of FIG. 2, wherein components are joined together; FIG. 4 is a perspective view of a cleaning head suitable for attachment of the cleaning sheet; FIG. 5 is a perspective view showing a state where the cleaning sheet is attached to the cleaning head; and FIG. 6 is a half sectional view showing a state where the cleaning sheet is attached to the cleaning head.

A disposable cleaning sheet 1 according to one embodiment of the present invention is designed to be attached to a cleaning head 31 of a cleaning device 30, as shown in FIG. 5.

As shown in FIGS. 1, 2, 3(A), 3(B), 5 and 6, the cleaning sheet 1 comprises a main body 2, which is intended to be placed on a bottom face 35*a* of the cleaning head 31, and attachment sheets 16, 16, which extend from opposite sides of the main body 2 and are intended to be secured on a top face of the cleaning head 31. The main body 2 has an attachment surface 4, which is intended to face the bottom face 35*a* of the cleaning head 31, and a cleaning surface 3, which is on the opposite side from the attachment surface 4 and intended to come into contact with an object to be cleaned.

As shown in the bottom view of FIG. 2, the main body 2 is of a rectangular shape, of which two parallel longer sides are designated "side edges 2*a*, 2*a*" and two parallel shorter sides are designated "end edges 2*b*, 2*b*". When the cleaning sheet 1 is used for cleaning a floor surface or the like, either of the side edges 2*a*, 2*a* is preferably situated forward in a wiping direction.

As shown in the exploded perspective view of FIG. 1, the main body 2 of the cleaning sheet 1 is constructed by stacking an exterior sheet 11, a support sheet 12, a substrate sheet 13 and a backing sheet 14 in order from the side of the cleaning surface 3.

The exterior sheet 11, the support sheet 12, the substrate sheet 13 and the backing sheet 14 have an equal width W in a direction parallel to the longer side (hereinafter called "transverse direction"). In a direction parallel to the shorter side (hereinafter called "longitudinal direction"), on the other hand, the support sheet 12 has a length L1, the exterior sheet 11 has a length L2, the substrate sheet 13 has a length L3 and the backing sheet 14 has a length L4. As shown in FIG. 2, the length L1 of the support sheet 12 is equal to the length of the main body 2.

The length L3 of the substrate sheet 13 is equal to the length L4 of the backing sheet 14. The length L3/L4 is shorter than the length L1 of the support sheet 12 and side edges 12*a*, 12*a* of the support sheet 12 are located outside side edges 13*a*, 13*a* of the substrate sheet 13, as shown in FIGS. 2 and 3(B).

The length L3 of the substrate sheet 13 is almost equal to or shorter than a length Ly of the cleaning head 31 shown in FIG. 4. On the other hand, the width W of the main body 2 is almost equal to a length Lx of the cleaning head 31.

As shown in FIG. 3(B), the length L2 of the exterior sheet 11 is shorter than the length L3 of the support sheet 12 and the length L4 of the backing sheet 14. In the cleaning surface 3 of the main body 2, accordingly, the exterior sheet 11 is located centrally (symmetrically about a centerline O-O) on the lower surface of the support sheet 12, as shown in FIGS. 2 and 3(B). Between the side edges 13*a* of the substrate sheet 13 and side edges 11*a* of the exterior sheet 11, the support sheet 12 is exposed externally. Furthermore, the support sheet 12 extends outward beyond the side edges 13*a* of the substrate sheet 13.

The dimensions of the substrate sheet 13 are not particularly limited as long as the cleaning sheet 1 can be suitably used for cleaning a floor surface or the like, but for example, the length L3 may be about 60 to 160 mm, the width W may be about 200 to 1000 mm.

The exterior sheet 11 and the support sheet 12 both contain heat-fusible synthetic resin fibers. The exterior sheet 11, the support sheet 12 and the substrate sheet 13 may be joined together by heating them under pressure, such as by heat embossing or ultrasonic embossing. FIG. 2 shows join lines 21 where the exterior sheet 11, the support sheet 12 and the substrate sheet 13 are joined together. The join lines 21 include wavy lines 21*a* representing an image of waves, complicatedly curved lines 21*b* representing an image of dolphins, and circular lines 21*c* representing an image of bubbles.

The wavy lines 21 have convexly curved portions near the side edges 2*a* of the main body 2 to provide boundaries 21*d*. In the area between the boundaries 2*d*, the exterior sheet 11, the support sheet 12 and the substrate sheet 13 are partially joined together. The boundaries 21*d* are spaced from the side edges 13*a* of the substrate sheet 13 toward the centerline O-O. In the areas outside the boundaries 21*d*, as shown in FIG.

3(B), the support sheet 12 is not joined to the substrate sheet 13 and is allowed to move freely.

Likewise, the boundaries 21*d* are spaced from the side edges 11*a* of the exterior sheet 11 toward the centerline O-O. In the areas outside the boundaries 21*d*, the exterior sheet 11 is not joined to the substrate sheet 13. However, the exterior sheet 11 is joined to the support sheet 12 in the areas outside the boundaries 21*d*. This joining may be performed by heat embossing or ultrasonic embossing, which provides join lines 22. As shown in FIG. 2, the join lines 22 are spaced inward from and parallel to the side edges 11*a* of the exterior sheet 11. In the areas outside the join lines 22, as shown in FIG. 3(B), the exterior sheet 11 is allowed to move freely away from the support sheet 12. These freely movable side edge portions of the exterior sheet 11 are flaps 11*b*.

On the other hand, the backing sheet 14 may be bonded to the attachment surface side of the substrate sheet 13 through a hot-melt type adhesive.

As shown in FIG. 1, a separable sheet 15 is laid on the attachment surface side of the main body 2. The separable sheet 15 has a cutting line 15*a* along the centerline O-O. This cutting line 15*a* may be perforation. When using the cleaning sheet 1, the separable sheet 15 may be torn along the cutting line 15*a* to separate into a pair of attachment sheets 16, 16. Since the separable sheet 15 has a circular opening 17 in the center thereof, as shown in FIG. 1, the individual attachment sheets 16, 16 after separation have semicircular indentations 16*b*, 16*b*.

As shown in FIG. 3(B), the separable sheet 15 (the attachment sheets 16, 16) is laid on the attachment surface side of the support sheet 12 in face-to-face relationship with side edges 16*a* aligned with the side edges 12*a* of the support sheet 12. Here, the separable sheet 15 is joined to the support sheet 12 to have join portions 25 with a given length as measured from the side edges 12*a*/16*a* toward the centerline O-O. The join portions 25 may be formed by bonding through a hot-melt type adhesive or heat sealing or ultrasonic sealing.

Each attachment sheet 16 after separation is allowed to move freely over the main body 2 inside an inner end 25*a* of the join portion 25. That is, each attachment sheet 16 is joined at a proximal end to the support sheet 12 in face-to-face relationship while having a distal end directed toward the centerline O-O. Thus, the main body 2 and the attachment sheet 16 form a pocket 26 inside the inner end 25*a*.

As shown in FIG. 3(B), the inner end 25*a* is spaced a distance Lb outward from the side edge 13*a* of the substrate sheet 13. The distance Lb may be 2 mm or more, preferably 4 mm or more, more preferably 5 mm or more.

The support sheet 12 is a stretchable sheet which is permitted to elastically stretch at least in the direction along which the support sheet 12 projects beyond the side edges 13*a* (or at least in the longitudinal direction of the cleaning sheet 1). Over a distance La between the join line 22 and the inner end 25*a* of the join portion 25, the support sheet 12 has stretchable portions 12*b* which are permitted to stretch more easily than the other portions. The distance La (or the length of the stretchable portion 12*b*) is preferably 10 mm or more, more preferably 15 mm or more.

Furthermore, the distance Lc between the join line 22 and the side edge 13*a* of the substrate sheet 13 (or the overlap length between the stretchable portion 12*b* and the substrate sheet 13) is preferably 5 mm or more, more preferably 10 mm or more.

The exterior sheet 11 is a liquid-permeable nonwoven fabric with a high fiber density. This nonwoven fabric contains at least 30 wt. % of synthetic resin fibers treated to be hydrophilic. Therefore, the exterior sheet 11 is wettable and permeable to liquid so that a liquid applied to the exterior sheet 11 can be transferred to the substrate sheet 13.

According to one embodiment, the exterior sheet 11 may be a spunbonded nonwoven fabric of splittable continuous filaments treated to be hydrophilic, wherein microfibers are split from the continuous filaments by applying high-pressure water stream to the spunbonded nonwoven fabric through water jet nozzles. In the exterior sheet 11 thus manufactured, the splitting of the continuous filaments creates voids which enable liquid permeation through the nonwoven fabric. Moreover, the split microfibers appear on the nonwoven fabric surface in a freely movable independent state, improving the effect of removing soil and making the nonwoven fabric surface soft and comfortable to the touch.

Alternatively, the exterior sheet 11 may be a nonwoven fabric of synthetic resin fibers (e.g., polyethylene (PE) fibers, polypropylene (PP) fibers, polyethylene terephthalate (PET) fibers, nylon fibers, acrylic fibers) treated to be hydrophilic with a surfactant, hydrophilic fibers (e.g., cotton, rayon, pulp), or a combination thereof. The nonwoven fabric may be manufactured by a spunlacing process or a point bonding process.

The support sheet 12 is an elastically stretchable, liquid-permeable nonwoven fabric with a low fiber density. This nonwoven fabric contains at least 70 wt. % of hydrophobic fibers. Preferably, the nonwoven fabric is manufactured by a through-air bonding process, such as by applying hot air to thermally bond PE fibers, PP fibers, PET fibers, PE/PP bicomponent fibers, PE/PET bicomponent fibers, or a combination thereof.

The support sheet 12 may have a basis weight in the range of 10 to 50 g/m$^2$ and a lower fiber density than the exterior sheet 11, for example, in the range of 0.015 to 0.075 g/cm$^3$.

When measured in the projecting direction away from the side edges 13*a* of the substrate sheet 13, the support sheet 12 has a higher elongation percentage than any of the substrate sheet 13, the attachment sheet 16 and the exterior sheet 11. When measured according to a measurement method that will be described later with reference to Example and Comparative Examples, the elongation percentage of the support sheet 12 is preferably 10% or more, more preferably 14% or more, in the projecting direction away from the side edges 13*a* (or in CD). The upper limit of the elongation percentage is not particularly defined but may be about 50%. The recovery percentage of the support sheet 12 after elongation in that direction (or in CD) is preferably 90% or more, more preferably 93% or more. The elastic modulus of the support sheet 12 is preferably 60% or more.

The elongation at break of the support sheet 12 is preferably 50% or more in that direction (or in CD). Here, the tensile strength at break is preferably 4 N or more per 25 mm width.

The support sheet 12 should not be construed as limited to the through-air bonded nonwoven fabric. For example, there may be employed a nonwoven fabric containing stretchable fibers of polyurethane resin, a stretchable net, a stretchable resin film with a number of apertures, or the like, as long as the elongation percentage and the recovery percentage fall within the specified ranges.

The substrate sheet 13 may be constructed by laying first and second substrate sheets 13*e*, 13*f* one on top of the other. The first and second substrate sheets 13*e*, 13*f* are both capable of absorbing water. According to one embodiment, both the first and second substrate sheets 13*e*, 13*f* may be an air-laid pulp in which pulp deposited by an air-laying process is bonded together through a resin binder. The substrate sheet 13 may have a total basis weight in the range of about 50 to 200 g/m$^2$. Alternatively, the substrate sheet 13 may be another deposited pulp sheet optionally containing superabsorbent polymer (SAP).

The substrate sheet 13 has a higher bending stiffness than the support sheet 12 and is inferior in stretchability to the support sheet 12, i.e., has a lower elongation percentage than the support sheet 12. The substrate sheet 13 should not be construed as limited to the air-laid pulp. For example, there may be used a paper material, a resin foam sheet, a nonwoven fabric such as spunlaced or spunbonded, or a stack thereof, as long as it has a higher bending stiffness than the support sheet 12 and is inferior in stretchability to the support sheet 12.

The substrate sheet 13, which is capable of absorbing water, can also function to keep the main body 2 unfolded and as a cushion layer between the bottom face of the cleaning head 31 and the floor surface.

The backing sheet 14 may be either of a liquid-blocking sheet and a liquid-permeable sheet. In the case where the backing sheet 14 is a liquid-permeable sheet, there may be employed a through-air bonded nonwoven fabric similar to that employed for the support sheet 12 or a spunlaced nonwoven fabric containing rayon and pulp. In the case where the backing sheet 14 is a liquid-blocking sheet, there may be employed a spunbonded nonwoven fabric or a spunbonded/meltblown (SM) nonwoven laminate treated with a water-repellent agent. Preferably used is a spunbonded nonwoven fabric which is formed of synthetic resin fibers treated to be hydrophilic and has a basis weight of 20 g/m$^2$.

The attachment sheet 16 may be a point-bonded or spunbonded nonwoven fabric of synthetic resin fibers. Preferably used is a spunbonded nonwoven fabric having a basis weight of about 40 g/m$^2$. Alternatively, the attachment sheet 16 may be a resin film. The attachment sheet 16 is inferior in stretchability to the support sheet 12 or substantially not stretchable. The elongation percentage of the attachment sheet 16 is preferably less than 10%, more preferably 5% or less. The recovery percentage is preferably 90% or more and the tensile strength at break is preferably 4 N or more per 25 mm width. It should be noted that preferred ranges of elongation percentage and recovery percentage of the exterior sheet 11 may be identical to those of the attachment sheet 16.

The cleaning device 30 shown in FIG. 4 has the cleaning head 31, a shaft 33 connected to the top face of the cleaning head 31 through a universal joint 32, and a grip (now shown) secured to an upper end of the shaft 33.

The cleaning head 31 has a generally rectangular contour. The cleaning head 31 is preferably constructed of a rigid holder 34 injection molded of a synthetic resin, such as acrylonitrile-butadiene-styrene (ABS), polyethylene (PE), polypropylene (PP), polyethylene terephthalate (PET), etc., and a pad 35 secured beneath the holder 34. The pad 35 is preferably formed of a flexible elastic material such as ethylene-vinyl acetate (EVA), urethane, or rubber. The bottom face of the cleaning head 31, i.e., the bottom face 35*a* of the pad 35 is generally flat.

In the top face, the holder 34 has sheet retainers 40 inside four corners of the rectangle. The sheet retainer 40 is preferably constructed by forming an opening 41 in the top face of the holder 34 and covering the opening 41 with a deformable sheet 42 made of PE, PP, PET, etc. The deformable sheet 42 has a cut 43. FIG. 5 shows a state where the cleaning sheet 1 is retained on the cleaning head 11 such that the attachment sheets 16, 16 are pushed into the cuts 43.

Centrally of the holder 34, there is mounted a nozzle head 36. The nozzle head 36 has three nozzles 37*a*, 37*b*, 37*c* whose orifices are directed to one side edge of the cleaning head 31. The shaft 33 is provided with a container holder (not shown) above the holder 34 for holding a container filled with a liquid. When a valve provided in the container holder is opened by operating a handle provided in the grip, the liquid inside the container can flow through a hollow 33*a* of the shaft 33 and a pipe 38 and into the nozzle head 36 and be squirted out of the cleaning head 31 from the nozzles 37*a*, 37*b*, 37*c*.

Next, how to use the cleaning sheet 1 in combination with the cleaning device 30 will be described.

The cleaning sheet 1 may be attached to the cleaning head 31 with the substrate sheet 13 and the backing sheet 14 of the main body 2 being located beneath the bottom face 35*a* of the pad 35. At first, the separable sheet 15, which covers the attachment surface 4 of the main body 2, is torn along the cutting line 15*a* to separate into the pair of attachment sheets 16, 16.

As set forth above, the proximal ends of the attachment sheets 16, 16 are joined to the support sheet 12 in face-to-face relationship to provide the join portions 25, whereby the pockets 26 are provided between the confronting faces of the main body 2 and the attachment sheets 16, inside the inner ends 25*a* of the join portions 25. When the cleaning head 31 is disposed between the main body 2 and the attachment sheets 16, as shown in FIG. 6, the longer side portions of the cleaning head 31 enter the pockets 26, so that the cleaning sheet 1 can be put in position with the substrate sheet 13 almost coinciding with the bottom face 35*a* of the pad 35.

Then, the attachment sheets 16, which lie on the top face of the cleaning head 31, are pushed into the cuts 43 of the sheet retainers 40. At this time, since the inner ends 25*a* of the join portions 25 are pulled upward, the stretchable portions 12*b* of the support sheet 12 can be slightly elastically stretched. Accordingly, the side edges 13*a* of the substrate sheet 13 and their vicinities can be tightly pressed against the bottom face 35*a* of the pad 35 by the stretchable portions 12*b*.

It should be noted that although the stretchable portion 12*b* shown in FIG. 6 is spaced away from the substrate sheet 13 and the cleaning head 31 for convenience of illustration, the stretchable portion 12*b* in practice can be tightly pressed against the substrate sheet 13 and the cleaning head 31. In the present embodiment, as shown in FIG. 3(B), since the join line 22 where the exterior sheet 11 is joined to the support sheet 12 is spaced inward away from the side edge 13*a* of the substrate sheet 13, the stretchable portion 12*b* overlaps with the substrate sheet 13 over the distance Lc.

Here, since the join line 22 is spaced inward away from the side edge 13*a* of the substrate sheet 13 and the distance La between the join line 22 and the inner end 25*a* of the join portion 25 is sufficient, the stretchable portion 12*b* can exert a sufficient elastic pressing force to tightly press the substrate sheet 13 against the bottom face 35*a* of the cleaning head 31 even if the elongation percentage of the support sheet 12 is not very high.

In the cleaning sheet 1, since the attachment sheets 16 are substantially not stretchable or inferior in stretchability, the force exerted to pull up the attachment sheets 16 acts intensively on the stretchable portions 12*b* of the substrate sheet 12, so that the side edges 13*a* of the substrate sheet 13 and their vicinities can be tightly pressed against the bottom face 35*a* of the cleaning head 31 by the stretchable portions 12*b*.

Should the attachment sheets 16 be highly stretchable, it will be difficult to tightly press the substrate sheet 13 against the bottom face 35*a* because the attachment sheets 16 themselves will be stretched by the force exerted to pull up the attachment sheets 16.

In the main body 2, furthermore, the distance Lb is set between the side edge 13*a* of the substrate sheet 13 and the inner end 25*a* of the join portion 25. Accordingly, when the cleaning sheet 1 is attached to the cleaning head 31, the join portions 25 can be placed on the side walls of the cleaning head 31, rather than on the bottom face 35*a*, as shown in FIG. 6. That is, the whole exterior sheet 11 can be located on the cleaning face of the cleaning head 31. This enables the whole bottom face 35*a* of the cleaning head 31 to be effectively exploited for cleaning and prevents the join portions 25 from damaging a delicate floor surface or the like.

When using the cleaning device 30, the handle of the grip may be operated to squirt the liquid from the nozzles 37*a*, 37*b*, 37*c* of the nozzle head 36 onto the floor surface in front of the cleaning head 31. After the floor surface is wetted with the liquid, the cleaning head 31 may be moved forward to wipe the floor with the cleaning sheet 1. The liquid to be squirted from the nozzles 37*a*, 37*b*, 37*c* may be plain water, or may contain a detergent for cleansing a floor surface, a high gloss wax, etc.

Since the exterior sheet 11, which is exposed externally on the cleaning surface 3 of the main body 2, and the support sheet 12, whose opposite side portions are also exposed externally outside the side edges 11*a* of the exterior sheet 11, are both hydrophilic and permeable to liquid, the liquid applied to the floor surface can pass through the exterior sheet 11 and the support sheet 12 and be absorbed by the substrate sheet 13, which is capable of absorbing water.

Fine dust or dirt can be collected by the exposed exterior sheet 11, while relatively large dust can be collected by the exposed side portions of the low-density support sheet 12. Moreover, the flaps 11*b* of the exterior sheet 11 are effective in removing grime on the floor surface.

Since the substrate sheet 13 can be tightly pressed against the bottom face 35*a* of the cleaning head 31 by an elastic force of the stretchable portions 12*b* of the support sheet 12 with the opposite side portions of the cleaning head 31 being held in the pockets 26 of the cleaning sheet 1, the substrate sheet 13 can be effectively prevented from being dislocated from the bottom face 35*a* of the cleaning head 31 by a friction caused between the cleaning sheet 1 and the floor surface or the like.

The present invention should not be understood as limited to the foregoing embodiment.

For example, the support sheet 12 may be exposed externally over the cleaning surface 3 of the main body 2 without providing the exterior sheet 11. Alternatively, the support sheet 12 may not extend over the cleaning surface 3 of the main body 2, and for example, may be of two separate sheets which are located outside the boundaries 21*d* shown in FIG. 3(B). Each sheet retainer may be constructed to include a clamping member which is pivotably mounted on the top face of the cleaning head for clamping the attachment sheet 16.

The cleaning sheet 1 may be attached to various cleaning devices other than the cleaning device 30. For example, the nozzles may be removed from the cleaning device and the liquid may be applied to the substrate sheet 13 otherwise. Alternatively, the substrate sheet 13 may be incapable of absorbing water and suitable for use in dry conditions.

EXAMPLE

(1) Example

For Example, there was prepared a through-air bonded nonwoven fabric having a basis weight of 30 g/m$^2$. This through-air bonded nonwoven fabric was formed of sheath/core (PE/PET) bicomponent fibers and suitable for use as the support sheet 12.

(2) Comparative Example 1

For Comparative Example 1, there was prepared a spunbonded nonwoven fabric having a basis weight of 40 g/m$^2$. This spunbonded nonwoven fabric was formed of PP fibers and suitable for use as the attachment sheet 16.

(3) Comparative Example 2

For Comparative Example 2, there was prepared a spunbonded nonwoven fabric having a basis weight of 20 g/m$^2$. This spunbonded nonwoven fabric was formed of PP fibers and suitable for use as the backing sheet 14.

(4) Comparative Example 3

For Comparative Example 3, there was prepared a spunlaced nonwoven fabric having a basis weight of 39 g/m$^2$. This spunlaced nonwoven fabric was formed of rayon, PET fibers and sheath/core (low-melting PP/high-melting PP) bicomponent fibers.

(5) Measurement Method

From Example and Comparative Examples 1-3, respectively, there were cut out two types of samples: one having a length of 130 mm along MD (machine direction) and a width of 25 mm along CD (cross direction); the other having a length of 130 mm along CD and a width of 25 mm along MD. Each sample was marked at points which were spaced 100 mm apart from each other in the longitudinal direction.

Both end portions of the sample outside the marks were held by a pair of opposing chucks to set a chuck-to-chuck distance L0 to 100 mm. The distance between the marks was measured when a tensile load of 2N was applied between the chucks for 30 seconds. This distance upon elongation was designated by L1. After measurement of the distance L1, one chuck was immediately released from the sample and the distance between the marks was again measured after 30 seconds after removal of the tensile load. This distance after recovery was designated by L2.

For Example and Comparative Examples 1-3, respectively, this measurement was performed three times.

(6) Evaluation

Elongation percentage (%) was obtained by (L1−L0)/L0*100. Recovery percentage (%) was obtained by L0/L2*100. Elastic modulus (strain recovery) (%) was obtained by {(L1−L0)−(L2−L0)}/(L1−L0)*100.

(7) CONCLUSION

The following Table 1 shows measurements of the distance L1 in both CD and MD for respective Example and Comparative Examples, the averages of three measurements of the distance L1, and the calculated elongation percentages.

The following Table 2 shows measurements of the distance L2 in both CD and MD for respective Example and Comparative Examples, the averages of three measurements of the distance L2, and the calculated recovery percentages.

It will be understood from below that the through-air bonded nonwoven fabric prepared for Example is preferably used with CD along the projecting direction away from the substrate sheet 13.

TABLE 1

| | Example | | Com. Example 1 | | Com. Example 2 | | Com. Example 3 | |
|---|---|---|---|---|---|---|---|---|
| Measurement under Load | CD | MD | CD | MD | CD | MD | CD | MD |
| First Measurement L1 (mm) | 119 | 101 | 100.5 | 100 | 105 | 102 | 149 | 100.5 |
| Second Measurement L1 (mm) | 117 | 102 | 102 | 100 | 103 | 101 | 149 | 101 |
| Third Measurement L1 (mm) | 118 | 101.5 | 101 | 100.5 | 105 | 101 | 154 | 101 |
| Average (mm) | 118 | 101.5 | 101.2 | 100.2 | 104.3 | 101.3 | 150.7 | 100.8 |
| Elongation Percentage (%) | 18 | 1.5 | 1.2 | 0.2 | 4.3 | 1.3 | 50.7 | 0.8 |

TABLE 2

| Measurement after | Example | | Com. Example 1 | | Com. Example 2 | | Com. Example 3 | |
|---|---|---|---|---|---|---|---|---|
| Removal of Load | CD | MD | CD | MD | CD | MD | CD | MD |
| First Measurement L2 (mm) | 105 | 100 | 100.5 | 100 | 100.5 | 100 | 125 | 100 |
| Second Measurement L2 (mm) | 104 | 100.5 | 101 | 100 | 101 | 100 | 125 | 100 |
| Third Measurement L2 (mm) | 103 | 100.5 | 100.5 | 100 | 100.5 | 100 | 128 | 100 |
| Average (mm) | 104 | 100.3 | 100.7 | 100 | 100.7 | 100 | 126 | 100 |
| Recovery Percentage (%) | 96.2 | 99.7 | 99.3 | 100 | 99.3 | 100 | 79.4 | 100 |

What is claimed is:

1. A cleaning sheet comprising a main body which is intended to be placed on a bottom face of a cleaning head and attachment sheets which extend from the main body and are intended to be secured on a top face of the cleaning head, the main body having an attachment surface and a cleaning surface on opposite sides, the attachment surface being intended to face the bottom face of the cleaning head, the main body including a substrate sheet and a stretchable support sheet disposed on a cleaning surface side of the substrate sheet to have projections extending beyond opposite side edges of the substrate sheet, each attachment sheet being joined to a respective projection of the support sheet.

2. The cleaning sheet of claim 1, wherein under an equal tensile stress, the support sheet has a higher elongation percentage than the substrate sheet and the attachment sheet.

3. The cleaning sheet of claim 1, wherein the support sheet has an elongation percentage of 10% or more when a tensile load of 2 N per 25 mm width is exerted for 30 seconds in a direction along which the projections project from the substrate sheet and a recovery percentage of 90% or more after 30 seconds after removal of the tensile load.

4. The cleaning sheet of claim 1, wherein each attachment sheet is joined at a proximal end to an attachment surface side of the support sheet in face-to-face relationship while having a distal end directed toward center of the main body.

5. The cleaning sheet of claim 1, wherein the attachment sheets are joined to the support sheet at locations spaced outward from the opposite side edges of the substrate sheet.

6. The cleaning sheet of claim 1, wherein the support sheet is joined to the cleaning surface side of the substrate sheet at locations spaced inward from the opposite side edges of the substrate sheet and is permitted to stretch outside the locations where the support sheet is joined to the substrate sheet.

7. The cleaning sheet of claim 1, wherein the support sheet is a through-air bonded nonwoven fabric.

* * * * *